US005128055A

United States Patent [19]

Foster

[11] Patent Number: 5,128,055

[45] Date of Patent: Jul. 7, 1992

[54] FABRIC CONDITIONING COMPOSITION

[75] Inventor: Francis G. Foster, Wirral, England

[73] Assignee: Lever Brothers Company, Division of Conopco, Inc., New York, N.Y.

[21] Appl. No.: 749,477

[22] Filed: Aug. 15, 1991

Related U.S. Application Data

[63] Continuation of Ser. No. 378,457, Jul. 11, 1989, abandoned, which is a continuation of Ser. No. 149,264, Jan. 28, 1988, abandoned.

[30] Foreign Application Priority Data

Jan. 29, 1987 [GB] United Kingdom ..... 8701963
Mar. 27, 1987 [GB] United Kingdom ..... 8707437

[51] Int. Cl.[5] ..... D06M 15/24
[52] U.S. Cl. ..... 252/8.9; 252/8.6; 252/173; 252/174.17; 252/DIG. 15
[58] Field of Search ..... 252/8.6, 8.8, 8.9, 108, 252/173, 174.17, 174.21, DIG. 3, DIG. 15

[56] References Cited

U.S. PATENT DOCUMENTS

| | | | |
|---|---|---|---|
| 4,000,093 | 12/1976 | Nicol et al. | 252/529 |
| 4,020,015 | 4/1977 | Bevan | 252/544 |
| 4,136,038 | 1/1979 | Pracht et al. | 252/8.8 |
| 4,230,590 | 10/1980 | Wixon | 252/97 |
| 4,237,016 | 12/1980 | Rudkin et al. | 252/8.8 |
| 4,532,067 | 7/1985 | Padron et al. | 252/DIG. 14 |
| 4,643,919 | 2/1987 | Fu | 252/8.9 |
| 4,732,693 | 3/1988 | Hight | 252/174.17 |
| 5,009,800 | 4/1991 | Foster | 252/8.9 |

*Primary Examiner*—Hoa Van Le
*Attorney, Agent, or Firm*—A. Kate Huffman

[57] ABSTRACT

A fabric conditioning composition in solid or liquid form contains a non-cationic softening agent and a non-ionic cellulose ether derivative to improve deposition of the softener on fabrics. Preferred derivatives have a gel point below 55° C. and an HLB of less than 3.6. Ethyl, hydroxylethyl cellulose ether is preferred. The exemplified softeners are soaps, petroleum jelly, glycerol monostearate. A cationic softener such as a quaternary ammonium salt may optionally be present. When the compositions are in liquid form the presence of a dispersing aid is preferred.

2 Claims, No Drawings

FABRIC CONDITIONING COMPOSITION

This is a continuation of application of Ser. No. 07/378,457, filed Jul. 11, 1989, now abandoned which is a continuation application of Ser. No. 149,264, filed Jan. 28, 1988, now abandoned.

BACKGROUND

This invention relates to fabric conditioning compositions, in particular to a non-alkaline fabric conditioning composition, intended to be used for the conditioning of fabrics in the rinse step of a fabric laundering process.

Fabric conditioning compositions traditionally contain a fabric softening material which is cationic in nature. While such compositions have been widely used, there is a desire to avoid or reduce the level of cationic material for a number of reasons, including cost. A number of non-cationic fabric softening materials are known, such as soap but the deposition and hence the softness delivery of such materials onto fabrics could be more efficient, especially in the absence of cationic materials.

British Patent Specifications GB 1456913 (Procter and Gamble) and 1453093 (Colgate) describe fabric softener compositions which contain both soap and a cationic material.

DISCLOSURE OF THE INVENTION

We have now discovered that the deposition of non-cationic fabric softeners can be improved by the presence of cellulose ether derivatives.

The presence of cellulose ether derivatives in alkaline fabric washing compositions is not unknown. Thus, South African Patent Specification No. 71/5149 (Unilever) describes the incorporation of certain nonionic cellulose ether polymers to reduce the redeposition of soil on hydrophobic fabrics.

According to the invention there is provided a fabric conditioning composition for treating fabrics in the rinse step of a fabric laundering process, the composition yielding of pH of less than 8.0 when added to water at a concentration of 1% by weight at 25° C, the composition comprising:

(i) from 1 to 40% by weight of a non-cationic fabric softening agent or mixture thereof with a cationic fabric softening agent, the cationic fabric softening agent, if present, being present in a minor amount relative to the amount of non-cationic fabric softening agent; and (ii) from 0.1 to 5% by weight of a nonionic cellulose ether derivative.

Also within the scope of invention is a process for conditioning fabrics comprising contacting said fabrics with an aqueous liquor having a pH of less than 8.0 and comprising, in addition to water:

(i) from 1 to 40% by weight of a non-cationic fabric softening agent or mixture thereof with a cationic fabric softening agent, the cationic fabric softening agent, if present, being present in a minor amoung relative to the amount of non-cationic fabric softening agent; and (ii) from 0.1 to 5% by weight of a nonionic cellulose ether derivative.

THE NON-CATIONIC FABRIC SOFTENING AGENT

The non-cationic fabric softening agent may be selected from nonionic and anionic fabric softening agents, examples of which include:

(i) soaps and derivatives thereof;

(ii) fatty acids;

(iii) hydrocarbons;

(iv) esters of polyhydric alcohols;

(v) lanolin and its derivatives;

(vi) alkylene oxide condensates of fatty materials such as fatty acids, amines, amides, alcohols and esters having an HLB of less than 10, preferably not more than 8.

When the fabric softening agent is a soap, this includes not only the usual alkali metal and alkaline earth metal salts of fatty acids, but also the organic salts which can be formed by complexing fatty acids with organic nitrogen-containing materials such as amines and derivatives thereof. Usually, the soap comprises salts of higher fatty acids containing from 8 to 24 carbon atoms, preferably from 10 to 20 carbon atoms in the molecule, or mixtures thereof.

Preferred examples of soaps include sodium stearate, sodium palmitate, sodium salts of tallow, coconut oil and palm oil fatty acids and complexes between stearic and/or palmitic fatty acid and/or tallow and/or coconut oil and/or palm oil fatty acids with water-soluble alkanolamines such as ethanolamine, di- or tri-ethanolamine, N-methylethanol- amine, N-ethylethanolamine, 2-methylethanolamine and 2,2-dimethyl ethanolamine and N-containing ring compounds such as morpholine, 2'-pyrrolidone and their methyl derivatives.

Mixtures of soaps can also be employed.

Particularly preferred are the sodium and potassium salts of the mixed fatty acids derived from coconut oil and tallow, that is sodium and potassium tallow and coconut soap.

Soap derivatives include the water-insoluble e.g. calcium salt equivalents of the soaps referred to above.

When the fabric softening agent is a fatty acid, this may be selected from $C_8$–$C_{24}$ alkyl or alkenyl monocarboxylic acids. Preferably tallow and hardened tallow $C_{16}$–$C_{18}$ fatty acids are used. Mixtures of various fatty acids may also be used.

When the fabric softening agent is a hydrocarbon, this may be a non-cyclic hydrocarbon having at least 10 carbon atoms, such as from 14 to 40 carbon atoms. Useful hydrocarbons include paraffins and olefines. Materials such as paraffin oil, soft paraffin wax and petroleum jelly are especially suitable.

Suitable esters of polyhydric alcohols include the esters formed between fatty acids having from 12 to 24 carbon atoms with polyhydric alcohols containing up to 8 carbon atoms. Specific examples include sorbitan esters such as sorbitan monostearate and sorbitan tristearate, ethylene glycol esters such as ethylene glycol monostearate, and glycerol esters such as glycerol monostearate.

The non-cationic fabric softening agent may be lanolin or its derivatives as described in EP-A-86106 (Unilever) and suitable such materials include lanolin itself, and propoxylated or acetylated lanolin.

When the non-cationic fabric softening agent is an alkylene oxide adduct of a fatty alcohol it will preferably have the general formula:

$$R^{10}—O—(C_nH_{2n}O)_yH$$

wherein $R^{10}$ is an alkyl or alkenyl group having at least 10 carbon atoms, most preferably from 10 to 22 carbon atoms, y most preferably is not more than 4.0, such as from about 0.5 to about 3.5 and n is 2 or 3. Examples of such materials include Synperonic A3 (ex ICI) which is a $C_{13}$-$C_{15}$ alcohol with about three ethylene oxide groups per molecule and Empilan KB3 (ex Marchon) which is lauric alcohol 3EO.

Alkylene oxide adducts of fatty acids useful as non-cationic fabrics softening agents in the present invention, preferably have the general formula $$R^{10}—C—O\ (C_nH_{2n}O)_yH$$

wherein $R^{10}$, n and y are as given above. Suitable examples include ESONAL 0334 (ex Diamond Shamrock) which is a tallow fatty acid with about 2.4 ethylene oxide groups per molecule.

Alkylene oxide adducts of fatty esters useful as non-cationic fabric softeners in the present invention include adducts of mono-, di- or tri-esters of polyhydric alcohols containing 1 to 4 carbon atoms; such as coconut or tallow oil (triglyceride) 3EO (ex Stearine Dubios).

Alkylene oxide adducts of fatty amines useful in the present invention, preferably have the general formula

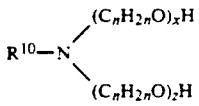

wherein $R^{10}$ and n are as given above, and x and z in total are preferably not more than 4.0, most preferably from about 0.5 to about 3.5. Examples of such materials include Ethomeen T12 (tallow amine 2EO, available from AKZO), Optamine PC5 (coconut alkyl amine 5EO) and Crodamet 1.02 (oleylamine 2EO, available from Croda Chemicals).

Alkylene oxide adducts of fatty amides useful in the present invention, preferably have the general formula

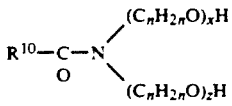

wherein $R^{10}$ and n are as given above, and x and z in total are preferably not more than 4.0, such as from about 0.5 to about 3.5 while one of x and z can be zero. Examples of such materials include tallow monoethanolamide and diethanolamide, and the corresponding coconut and soya compounds.

THE NONIONIC CELLULOSE ETHER DERIVATIVE

The preferred cellulose ether derivative useful in the present invention are those derivatives having a gel point below 55° C. more preferably between 33° C. and 55° C. and/or an HLB of less than 3.6 more preferably between 3.0 and 3.6 and containing substantially no hydroxyalkyl groups having three or more carbon atoms.

HLB is a well known measure of the hydrophilic-lyophilic balance of a material and can be calculated from its molecular structure. A suitable estimation method for emulsifiers is described by J T Davies, 2nd Int Congress of Surface Activity 1957, I pp 426–439. This method has been adopted to derive a relative HLB ranking for cellulose ether polymers by summation of Davies's HLB assignments for substituent groups at the three available hydroxyl sites on the anhydroglucose ring of the polymer. The HLB assignments for substituent groups include the following:

| | |
|---|---|
| Residual hydroxyl | 1.9 |
| Methyl | 0.825 |
| Ethyl | 0.350 |
| Hydroxy ethyl | 1.63 |

The cellulose ether derivatives useful herein polymers. The gel point of polymers can be measured in a number of ways. In the present context the gel point is measured on a polymer solution. The polymer solution is prepared at a concentration of 10 g/l by forming a dispersion at 60°–70° C. in deionised water and then cooling to 25° C. A 50 ml solution of the polymer is placed in a beaker and heated with stirring, at a heating rate of approximately 5° C./minute. The temperature at which the solution clouds is the gel point of the cellulose ether being tested and is measured using a Sybron/-Brinkmann colorimeter at 80% transmission/450 nm.

Provided that the HLB and gel point of the polymer fall within the required ranges, the degree of substitution (DS) of the anhydroglucose ring may be any value up to the theoretical maximum value of 3, but is preferably from about 1.9–2.9, there being a maximum of 3 hydroxyl groups on each anhydroglucose unit in cellulose. The expression 'molar substitution' (MS) is sometimes also used in connection with these polymers and refers the number of hydroxyalkyl substituents per anhydroglucose ring and may be more than 3 when the substituents themselves carry further substituents.

The most highly preferred polymers have an average number of anhydroglucose units in the cellulose polymer, or weight average degree of polymerisation (DP), from about 50 to about 1,200 more preferably from about 70. For efficient softener deposition polymers with a high DP e.g.1200 are preferred. Polymers with a higher DP give solutions with an unacceptably high viscosity. For certain product forms, e.g. liquids, it may be desirable to include polymers of relatively low degree of polymerisation to obtain a satisfactory product viscosity.

A number of cellulose ether derivatives suitable for use in the present invention are commercially available, as follows:

| Trade Name | Gel point °C. | HLB (Davies) | DS/MS alkyl/hydroxalkyl |
|---|---|---|---|
| BERMOCOLL CST035 (ex Berol Kemi) | 35 | 3.40 | 1.4 ethyl<br>0.5 hydroxyethyl |
| TYLOSE MHB 1000 (ex Hoechst) | 54 | 3.52 | 2.0 methyl<br>0.1 hydroxyethyl |

THE OPTIONAL CATIONIC FABRIC SOFTENING AGENT

When the compositions of the invention additionally contain a cationic fabric softening agent, this is present in a minor amount relative to the non-cationic softener and may be selected from quaternary ammonium compounds, imidazolinium derivatives, fatty amines, and mixtures thereof.

The cationic fabric softening material is preferably a cold water-insoluble material, that is a material having a solubility at 20° C. of less than 10 g/l in water at a pH value of about 6.

Highly preferred water-insoluble quaternary ammonium compounds are those having two $C_{12}$-$C_{24}$ alkyl or alkenyl chains, optionally substituted by functional groups such as —OH, —O—, —CONH—, —COO— etc.

Well known species of substantially water-insoluble quaternary ammonium compounds have the formula

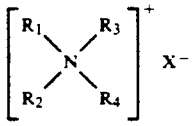

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula:

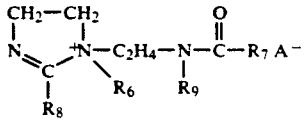

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-) ethyl -2-tallowyl- 4,5-dihydro imidazolinium methosulfate and 1-methyl-1- (palmitoylamido)ethyl -2-octadecyl-4,5- dihydroimidazolinium chloride. Other useful imidazolinium materials are 2-heptadecyl-1-methyl-1- (2-stearylamido)-ethyl- imidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference. As used herein the term "fabric softening agent" excludes cationic detergent active materials which have a solubility above 10 g/l in water at 20° C. at a pH of about 6.

Other preferred fabric softening agents include water-insoluble tertiary amines having the general formula:

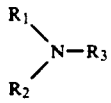

wherein $R_1$ is a $C_{10}$-$C_{26}$ alkyl or alkenyl group, $R_2$ is the same as $R_1$ or if $R_1$ is a $C_{20}$-$C_{26}$ alkyl or alkenyl group, may be a $C_1$-$C_7$ alkyl group and $R_3$ has the formula $—CH_2—Y$, wherein Y is H, $C_1$-$C_6$ alkyl, phenyl, $—CH_2OH$, $—CH=CH_2$. $—CH_2CH_2OH$,

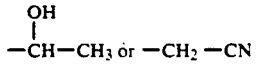

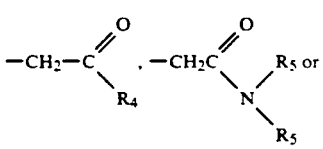

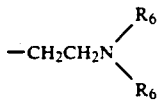

wherein $R_4$ is a $C_1$-$C_4$ alkyl group, each $R_5$ is independently H or $C_1$-$C_{20}$, and each $R_6$ is independently H or $C_1$-$C_{20}$ alkyl.

Preferably $R_1$ and $R_2$ each independently represent a $C_{12}$-$C_{22}$ alkyl group, preferably straight-chained and $R_3$ is methyl or ethyl. Suitable amines include: didecyl methylamine; dilauryl methylamine; dimyristyl methylamine; dicetyl methylamine; distearyl methylamine; diarachidyl methylamine; dibehenyl methylamine; arachidyl behenyl methylamine or di (mixed arachidyl/behenyl) methylamine; di (tallowyl) methylamine; arachidyl/behenyl dimethylamine and the corresponding ethylamines, propylamines and butylamines. Especially preferred is ditallowyl methylamine. This is commercially available as Armeen M2HT from AKZO NV, as Genamin SH301 from FARBWERKE HOECHST, and as Noram M2SH from the CECA COMPANY.

When Y is

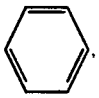

$—CH=CH_2$, $—CH_2OH$,

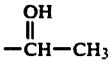

or $—CH_2—CN$, suitable amines include: didecyl benzylamine; dilauryl benzylamine; dimyristyl benzylamine; dicetyl benzylamine; distearyl benzylamine; dioleyl benzylamine; dilinoleyl benzylamine; diarachidyl benzylamine; dibehenyl benzylamine; di (arachidyl/-behenyl) benzylamine, ditallowyl benzylamine and the corresponding allylamines, hydroxy ethylamines, hydroxy propylamines and 2-cyanoethylamines. Especially preferred are ditallowyl benzylamine and ditallowyl allylamine.

Mixtures of any of these amines may be used.

THE COMPOSITION

The compositions of the invention may be in any physical form, such as powders or liquids. When in the form of powders the specified ingredients of the composition may be mixed with a carrier material, especially a water-soluble inert carrier material such as sodium sulphate.

Liquid forms of the compositions of the invention are, however, particularly convenient. Specified ingredients are suspended or dissolved in an aqueous base. The concentration of fabric softening agent in such a product form, including both the non-cationic fabric softening agent and the cationic fabric softening agent, when present, should be from 1.0% to 40% by weight, preferably from 3% to 20%. The ratio of the non-cationic fabric softening agent to the cationic fabric softening agent is at least 2.0:1. The level of the cellulose ether derivative in such a product form is from 0.1% by weight to 5% by weight, preferably from 0.2% to 2%. A suitable weight ratio for the fabric softening agent or agents to the cellulose ether derivative is from 50:1 to 2:1, ideally from 20:1 to 5:1.

When the product is in liquid form, the presence of a dispersing aid is preferred to improve the physical stability of the product. This dispersing aid should be a water-soluble non-anionic surfactant having an HLB of greater than 10, ideally greater than 12. Materials which fall within the definition of the cationic fabric softening agent used above are excluded. In this context, the term "water-soluble" means having a solubility of more than 1.0g/l in water at pH 2.5 and at 20° C. Preferred examples include water-soluble quaternary ammonium salts(-such as Arquad 16), ethoxylated quaternary ammonium salts (such as Ethoquad 0/12), quaternary diamine and ethoxylated diamine salts (such as Duoquad T), ethoxylated amines and diamines (such as Ethoduomeen T/25, Ethomeen T/15) and their acid salts, ethoxylated fatty esters of polyhydric alcohols (such as sorbitan monolaurate 20 EO), ethoxylated fatty alcohols (such as Dobanol 45 11EO - C14/15 alcohol 11 EO) and ethoxylated fatty acids (such as Myrj 49 - stearic acid 20 EO).

A useful test for whether a particular material will be a suitable dispersing aid is one which results in a lower product viscosity.

The dispersing aid may be present at a level of at least 0.1%, preferably at least 0.2% by weight based on the final product. Usually, it will not be necessary to use more than 2.5%, preferably not more than 1.0% dispersing aid.

OTHER OPTIONAL INGREDIENTS

The compositions may also contain one or more optional ingredients selected from electrolytes, such as the salts of alkali metals and alkaline earth metals, non-aqueous solvents such as $C_1$–$C_4$ alkanols and polyhydric alcohols, pH buffering agents such as weak acids e.g. phosphoric, benzoic or citric acids (the pH of the compositions are preferably less than 6.0), antigelling agents, perfumes, perfume carriers, fluorescers, colourants, hydrotropes, antifoaming agents, other antiredeposition agents, enzymes, optical brightening agents, opacifiers, stabilisers such as guar gum and polyethylene glycol, anti-shrinking agents, anti-wrinkle agents, fabric crisping agents, spotting agents, soil-release agents, germicides, fungicides, anti-oxidants, anti-corrosion agents, preservatives, dyes, bleaches and bleach precursors, drape imparting agents and antistatic agents.

The compositions of the invention may be prepared by any suitable method known in the art for preparing rinse conditioner products.

The invention will now be illustrated by the following non-limiting examples.

EXAMPLES 1 TO 13

A composition (Example 1 of the following table) was prepared by dissolving a dispersing aid in demineralised water at 60° C. To the solution sodium hydroxide pellets were added followed by addition and dissolution of tallow fatty acid (at 55°-60° C.) to form a soap dispersion. A cationic softener and cellulose ether derivative were co-melted an d the liquid melt added to the soap dispersion (at 50°-55° C.) with vigorous stirring.

The preparation was then cooled to room temperature without vigorous stirring to facilitate dissolution of the cellulose ether derivative without excessive foaming.

Examples 2 and 3 were prepared in an analogous manner.

The compositions of Examples 4 to 13 were prepared by adding to water at 80° C. a molten premix of the cationic softener and petroleum jelly with vigorous stirring to form a dispersion and then cooling to 60° C. before adding the cellulose ether derivative in powder form.

| Example No: | 1 | 2* | 3 | 4* | 5* | 6 | 7 |
|---|---|---|---|---|---|---|---|
| Ingredients (% by weight) | | | | | | | |
| Non-cationic softener | | | | | | | |
| Potassium tallow soap | — | 3.5 | 3.5 | — | — | — | — |
| Sodium tallow soap | 3.5 | — | — | — | — | — | — |
| Petroleum jelly[1] | — | — | — | 3.5 | 3.5 | 3.5 | 3.5 |
| Cationic softener | | | | | | | |
| Arquad 2HT[2] | 1.5 | 1.5 | 1.5 | 1.5 | 1.5 | 1.5 | 1.5 |
| Dispersing aid | | | | | | | |
| Dobanol 45 11 EO[3] | 1.0 | 1.0 | 1.0 | — | 0.5 | 0.5 | — |
| Cellulose ether derivative | | | | | | | |
| Bermocoll CST 035 | 0.5 | — | 0.5 | — | — | 0.5 | 1.0 |
| Water | | | balance | | | | |

| Example No: | 8* | 9 | 10* | 11 | 12* | 13 |
|---|---|---|---|---|---|---|
| Ingredients (% by weight) | | | | | | |
| Non-cationic softener | | | | | | |
| Tallow monoethanolamide | 3.5 | 3.5 | — | — | — | — |
| Glycerol monostearate | — | — | 3.5 | 3.5 | 7.0 | 7.0 |
| Cationic softener | | | | | | |
| Arquad 2HT[2] | 1.5 | 1.5 | 1.5 | 1.5 | 3.0 | 3.0 |
| Dispersing aid | | | | | | |
| Dobanol 45 11 EO | 1.0 | 1.0 | 0.5 | 0.5 | 1.0 | 1.0 |
| Cellulose ether derivative | | | | | | |
| Bermocoll CST 035 | — | 0.5 | — | 0.5 | — | 0.5 |

*Comparative example

Notes

[1]Silkolene 910, melting point 45-55° C.

[2]A commercial form of di-hardened tallow dimethyl ammonium chloride.

[3]A water soluble nonionic surfactant which is an ethoxylated fatty alcohol with approximately 11 ethylene oxide groups per molecule.

The above compositions were tested as follows.

A fabric load comprising terry towelling monitors was washed in a commercially available fabric washing product, and then rinsed three times for 5 minutes, a composition to be tested being added to the final rinse at a concentration of 2 g/l, with the exception of Examples 12 and 13 where the dosage level was 1 g/l.

The fabric load was then line-dried. After drying, the terry towelling monitors were assessed for softness subjectively by expert judges who assess softness by comparison of pairs of monitors leading to preferance scores which are then adjusted to give a score of zero for the control. A positive score indicates better softness than the control. The results are set out in the following tables.

| Example No | Relative Softening Score |
|---|---|
| 1 | +0.94 |
| 2* | 0 |
| 3 | +0.79 |
| 4* | 0 |
| 5* | −0.34 |
| 6 | +0.63 |
| 7 | +0.55 |
| 8* | 0 |
| 9 | +0.69 |
| 10* | 0 |
| 11 | +0.70 |
| 12* | 0 |
| 13 | +1.28 |

The comparison of Examples 1, 2 and 3 demonstrates that the presence of the cellulose ether derivative in Examples 1 and 3 leads to improved softening performance.

The comparison of Examples 4, 5, 6 and 7 shows the negative effect of the presence of the dispersing aid in Example 5, which is more than overcome by the presence of the cellulose ether derivative in Example 6.

The comparison of Examples 8 and 9 and Examples 10, 11, 12 and 13 demonstrate that the presence of the cellulose ether derivative (Examples 9, 11 and 13) leads to an improvement in softening performance when the non-cationic softener is tallow monoethanolamide or glycerol monostearate.

EXAMPLES 14 TO 19

The following examples illustrate the benefits of cellulose ether derivatives, even in compositions which contain no cationic softener. The non-cationic softener was the calcium salt of tallow fatty acid and the compositions were prepared in an analogous manner to Example 1, except that after the dissolution of the fatty acid, a solution of calcium chloride containing a portion of the dispersing aid was added to form a dispersion of the calcium fatty acid salt before addition of the cationic softener and cellulose ether derivative. The compositions therefore additionally contained an amount of sodium chloride formed in situ. The formulations tested and results obtained are as set out in the following table. The procedure used was the same as in Examples 1 to 13.

| Example No: | 14 | 15 | 16 | 17* |
|---|---|---|---|---|
| Ingredients (%) | | | | |
| Non-cationic softener | 5 | 10 | 20 | 20 |
| Dobanol 45 11 EO | 1 | 2 | 4 | 4 |
| Bermocoll CST 035 | 0.5 | 0.5 | 0.5 | — |
| Water & sodium chloride | | balance | | |
| Softening score | +1.02 | +1.29 | +1.45 | 0 |

-continued

| Example No: | 18* | 19 |
|---|---|---|
| Ingredients (%) | | |
| Non-cationic softener | 5 | 5 |
| Ethoduomeen HT/25.[4] | 1.0 | 1.0 |
| Bermocoll CST 035 | — | 0.5 |
| Water & sodium chloride | balance | |
| Softening score | 0 | +1.11 |

*Comparative example

[4]A commercial form of N, N-, N-polyethylene oxide (15) N hardened tallow 1, 3 diamino propane.

Example 19 demonstrates that the benefit of cellulose ether derivatives is also obtained if the Dobanol 45 11EO is replaced by an alternative dispersing aid, such as Ethoduomeen HT/25.

EXAMPLE 20

Compositions were prepared containing 4% calcium salt of tallow fatty acid, 1% Arquad 2HT, 0.5% Dobanol 45 11 EO and 0.5% cellulose ether derivative, the balance being water. A number of different commercially available cellulose ether derivatives were used. Test procedures were as in Examples 1 to 13 with the exception that the dosage level was 1 g/l and the monitors were judged against presoftened standards representing a scale extending from 2 (soft) to 14 (harsh).

The cellulose ethers used and the results obtained are set out in the following table.

| Cellulose ether derivative | Gel point °C. | HLB (Davies) | DS/MS alkyl/ hydroxyalkyl | Softening Score |
|---|---|---|---|---|
| BERMOCOLL CST 035 | 35 | 3.40 | 1.4 ethyl 0.5 hydroxyethyl | 6.5 |
| PROBE D* | 33 | 3.01 | 2.5 methyl | 7.8 |
| TYLOSE MHB 1000 | 54 | 3.52 | 2.0 methyl 0.1 hydroxyethyl | 8.0 |
| BERMOCOLL E351 | 56 | 3.77 | 0.8 ethyl 2.2 hydroxyethyl | 9.5 |
| BERMOCOLL E230 | 65 | 4.09 | 0.9 ethyl 0.8 hydroxyethyl | 8.5 |
| TYLOSE MH 300 | 58 | 4.05 | 1.5 methyl 0.1 hydroxyethyl | 8.8 |

*Experimental sample (ex Hoechst)

These results demonstrate a preference for cellulose ether derivatives having a gel point of less than 55° C. and an HLB of less than 3.6.

EXAMPLE 21

Using the preparation process and test method described in Examples 1 to 13 above, the following compositions were prepared and tested:

| Example No: | 21 | 2* | 3 |
|---|---|---|---|
| Ingredients (% by weight) | | | |
| Non-cationic softener | | | |
| Tallow fatty acid | 3.5 | — | — |
| Potassium tallow soap | — | 3.5 | 3.5 |
| Cationic softener | | | |
| Arquad 2HT | 1.5 | 1.5 | 1.5 |
| Dispersing aid | | | |
| Dobanol 45 11 EO | 0.5 | 1.0 | 1.0 |
| Cellulose ether derivative | | | |
| Bermocoll CST 035 | 0.5 | — | 0.5 |
| Water | | balance | |

*Comparative example

The results were as follows:

| Example No. | Relative Softening Score |
|---|---|
| 21 | +1.64 |
| 2* | 0 |
| 3 | +0.79 |

These results demonstrate that the present invention is particularly effective when the non-cationic softener is a fatty acid.

Similarly, beneficial results are obtained when an ethoxylated tallow fatty amide with approximately 11 ethylene oxide groups per molecule is used as a dispersing aid in place of Dobanol 45 11 EO.

Similarly, beneficial results are obtained with compositions containing 10% tallow fatty acid, 2.5% dispersing aid (selected from those described above) and 0.5% of the cellulose ether derivative, i.e. a composition containing no cationic softener.

EXAMPLES 22-27

The following examples illustrate the benefits of cellulose ether derivatives in compositions containing a blend of soaps as the non-cationic fabric softening agent. Compositions according to the formulations given below were prepared by the following method. Potassium and sodium hydroxide pellets were dissolved in a small quantity of water and triethanolamine and optionally Dobanol 45 11EO were added. The solution thus formed was heated and maintained at 60° C. Optionally, methanol was added. (Methanol was only present in the formulations given in Examples 26 and 27 i.e. those containing 20% soap.) The fatty acid mixture of oleate/coconut was melted by heating to 80° C. and added with stirring to the solution. This was followed by the addition of water at a temperature of 70° C. Finally, the cellulose ether was added (at 60° C.) with vigorous stirring. The compositions were then cooled to room temperature with gentle stirring to facilitate dissolution of the cellulose ether derivative without excessive foaming.

| Example No. | 22* | 23 | 24* | 25 | 26 | 27* |
|---|---|---|---|---|---|---|
| Ingredients (% by weight) | | | | | | |
| Non-cationic softener | | | | | | |
| Blend of oleate/coconut soap in a 1.4:1 ratio | 10 | 10 | 10 | 10 | 20 | 20 |
| Dispersing Aid | | | | | | |
| Dobanol 45 11EO | — | — | 0.5 | 0.5 | 1.0 | 1.0 |
| Cellulose ether derivative | | | | | | |
| Bermocoll CST 035 | — | 0.5 | — | 0.5 | 0.5 | — |
| Methanol | | | | | 10 | 10 |

*Comparative example

The above compositions were tested according to the procedure given in Examples 1 to 13. The following results were obtained.

| Example No. | Relative Softening Score |
|---|---|
| 22* | 0 |
| 23 | +0.27 |
| 24* | −1.23 |
| 25 | +0.37 |
| 26 | +0.96 |
| 27* | 0 |

The comparison of Examples 22, 23, 24 and 25 shows the negative effect the presence of the dispersing aid has on softening performance (Example 24) which is more than overcome by the presence of the cellulose ether derivative (Example 25).

The comparison of Examples 26 and 27 shows the benefit of the inclusion of the cellulose ether derivative is also obtained if the level of the non-cationic fabric softener is increased to 20%.

I claim:

1. A liquid fabric rinse conditioning composition for treating fabrics in the rinse step of a fabric laundering process, the composition yielding a pH below 8.0 when added to water at a temperature of 25° C. in a concentration of 1% by weight, the composition consisting essentially of:

(i) from 1 to 40% by weight of a non-cationic fabric softening agent or a mixture of a non-cationic fabric softening agent with a cationic fabric softening agent, the weight ratio of the non-cationic fabric softening agent to the cationic fabric softening agent being at least 2:1; and (ii) from 0.1 to 5% by weight of an ethyl hydroxyethyl cellulose ether having an HLB-value of below 3.6, a gel point of below 55° C. and a DP of between 70 and 1200; and (iii) from 1-2.5% by weight of a water-insoluble non-anionic surfactant, having an HLB of greater than 10, as dispersing aid.

2. A composition according to claim 1 wherein the non-cationic fabric softening agent is selected from (i) saps;

(ii) fatty acids;

(iii) hydrocarbons;

(iv) esters of polyhydric alcohols;

(v) lanolin; and (vi) alkylene oxide condensates of fatty materials.

* * * * *